US005966575A

United States Patent [19]

Wayman et al.

[11] Patent Number: 5,966,575

[45] Date of Patent: Oct. 12, 1999

[54] PNEUMATIC SPRING FOR SED RESISTANCE BRUSH COMMUTATOR

[75] Inventors: William H. Wayman, Ontario; Robert B. Anderson, Jr., Rochester, both of N.Y.

[73] Assignee: Xerox Corporation, Stamford, Conn.

[21] Appl. No.: 09/196,593

[22] Filed: Nov. 20, 1998

[51] Int. Cl.[6] ..... G03G 15/08; G03G 15/09

[52] U.S. Cl. ..... 399/266; 399/270

[58] Field of Search ..... 310/243, 247, 310/248, 239; 399/222, 252, 265, 266, 279, 290, 292, 293, 291, 99, 92, 93, 98, 91

[56] References Cited

U.S. PATENT DOCUMENTS 5,172,170 12/1992 Hays et al. ..... 355/259

5,289,240 2/1994 Wayman ..... 355/259

*Primary Examiner*—Arthur T. Grimley
*Assistant Examiner*—Hoang Ngo
*Attorney, Agent, or Firm*—Lloyd F. Bean II

[57] ABSTRACT

An apparatus for developing a latent image recorded on a surface, including; a housing defining a chamber storing at least a supply of toner therein; a donor member spaced from the surface and adapted to transport toner from the chamber of the housing to a development zone adjacent the surface; a plurality of electrodes longitudinally disposed on the donor member; and a commutator brush contacting the electrodes along a portion of the circumference of the donor member, said commutator brush including means for generating pneumatic force to move said commutator brush into contact with the electrodes.

2 Claims, 4 Drawing Sheets

PNEUMATIC SPRING FOR SED RESISTANCE BRUSH COMMUTATOR

This invention relates generally to an electrophotographic printing machine and more particularly concerns a pneumatic spring for a SED resistance brush commutator.

Generally, the process of electrophotographic printing includes charging a photoconductive member to a substantially uniform potential to sensitize the photoconductive surface thereof. The charged portion of the photoconductive member is exposed to a light image of an original document being reproduced. This records an electrostatic latent image on the photoconductive member. After the electrostatic latent image is recorded on the photoconductive member, the latent image is developed by exposing it to a population of charged, pigmented toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

A type of development system is disclosed in U.S. Pat. No. 5,172,170, assigned to the assignee of the present application, discloses a "scavengeless" development unit in which a set of longitudinally-disposed electrodes is embedded in the surface of a rotating donor roll. A wiping brush is used to energize or commutate those electrodes in the development zone. When the electrodes are energized, the toner near the electrodes jumps off the donor roll and forms a powder cloud which may be used to develop the latent image. In this development unit the electric fields which generate the cloud are generally those formed between the electrodes and a conductive core within the donor roll.

A problem with brush commutation schemes rely on mechanical compression springs to maintain brush contact with the donor roll. In order to obtain the required spring forces and travel distances, a minimum amount of space behind the commutation brush is required. It is exceedingly difficult to package this required geometry within the development housing without impacting existing hardware. Moreover, there is a problem with contamination from toner which can interfere with the brush electrical contact with the commutator. Also there is a problem of undesirable ozone generation in the commutation area.

An object of the present invention is to reduce the minimum amount of space behind the commutation brush and to reduces the problems associated with toner contamination and ozone generation.

There is provided an apparatus for developing a latent image recorded on a surface, including; a housing defining a chamber storing at least a supply of toner therein; a donor member spaced from the surface and adapted to transport toner from the chamber of the housing to a development zone adjacent the surface; a plurality of electrodes longitudinally disposed on the donor member; and a commutator brush contacting the electrodes along a portion of the circumference of the donor member, said commutator brush including means for generating pneumatic force to move said commutator brush into contact with the electrodes.

Other features of the present invention will become apparent as the following description precedes and upon reference to the drawings, in which.

Figure 4:
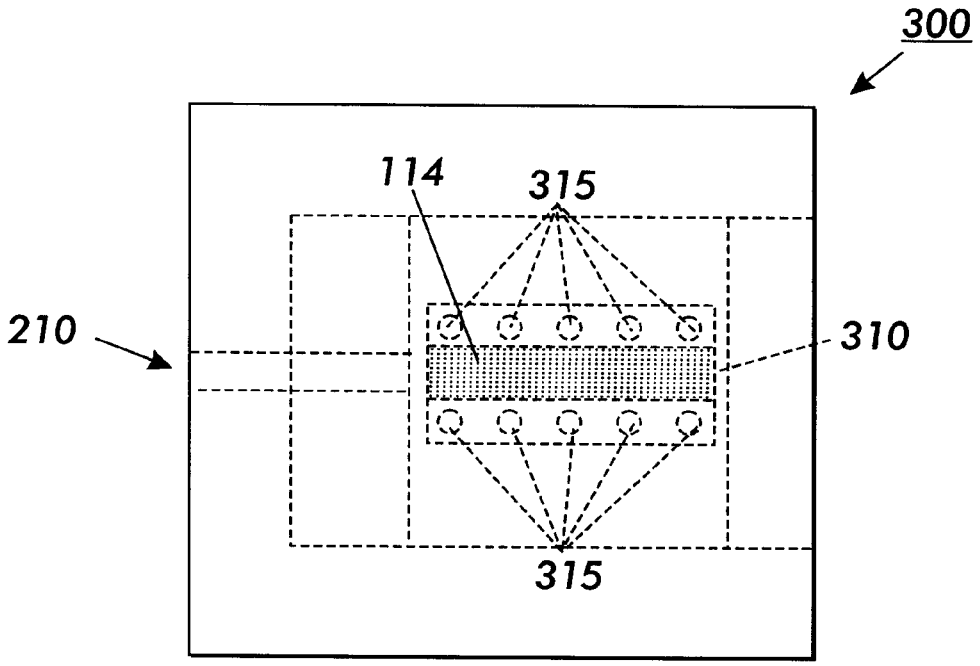
FIG. 4 is a top view of a second embodiment of the present invention.

Inasmuch as the art of electrophotographic printing is well known, the various processing stations employed in the FIG. 4 printing machine will be shown hereinafter schematically and their operation described briefly with reference thereto.

Figure 1:
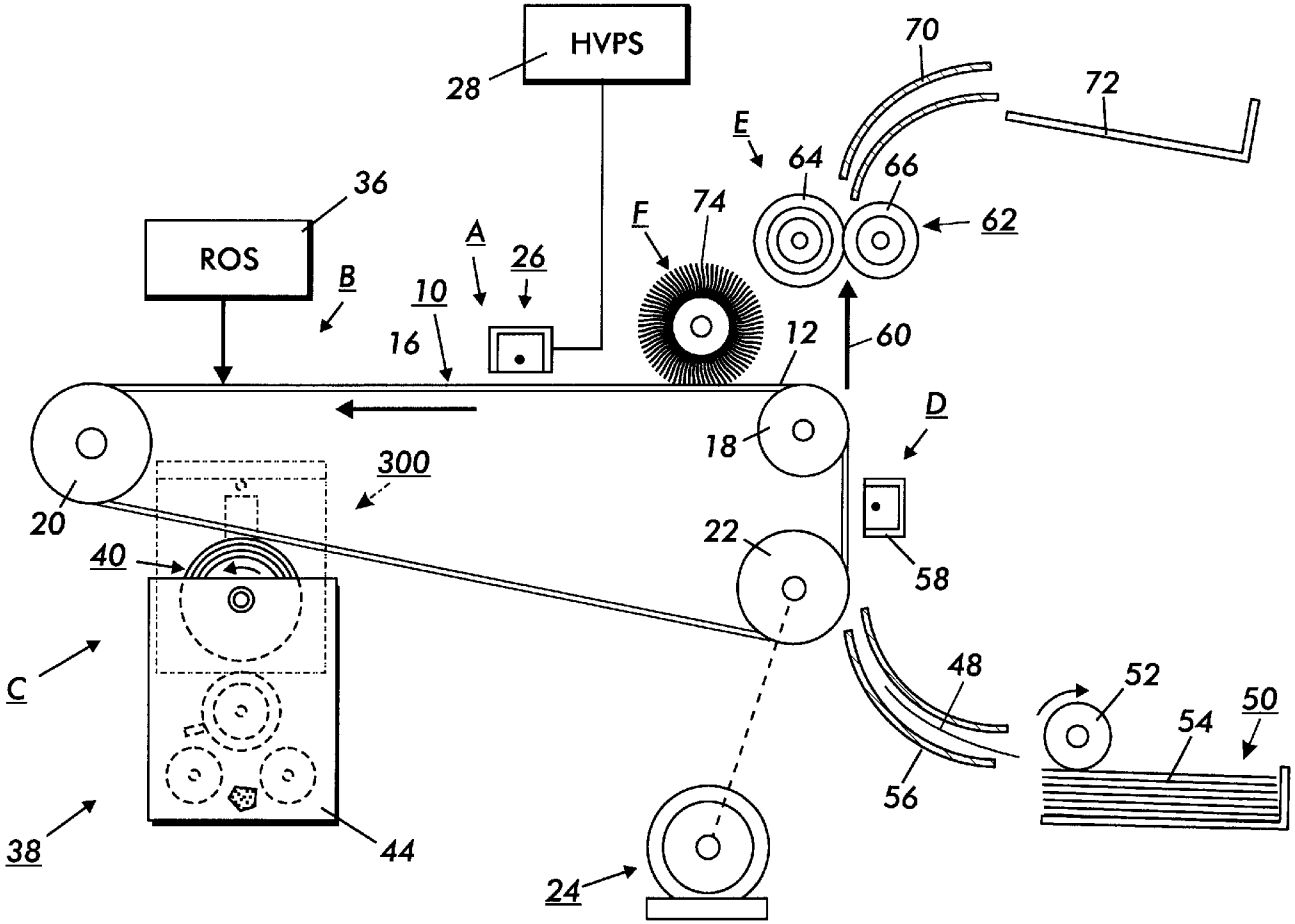
FIG. 1 is a schematic elevational view showing the developer apparatus according to an embodiment of the invention.

Referring initially to FIG. 1, there is shown an illustrative electrophotographic printing machine incorporating the development apparatus of the present invention therein. The electrophotographic printing machine employs a belt 10 having a photoconductive surface 12 deposited on an electrically grounded conductive substrate 14. One skilled in the art will appreciate that any suitable photoconductive material may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a suitable pair of springs (not shown) resiliently urging tensioning roller 20 against belt 10 with the desired spring force. Stripping finger 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30. A raster output scanner 36 layouts an image in a series of horizontal scan lines with each line having a specified number of pixels per inch, which selectively dissipates the charged on photoconductive surface 12, thus recording an electrostatic latent image. Typically, a raster output scanner includes a laser with a rotating polygon mirror block and a modulator.

After the electrostatic latent image has been recorded on photoconductive surface 12, belt 10 advances the latent image to development station C. At development station C, a developer unit, indicated generally by the reference numeral 38 develops the latent image recorded on the photoconductive surface. Preferably, developer unit 38 includes a donor roller 40 having a plurality of electrodes or electrical conductors 42 embedded therein and integral therewith. The electrical conductors are substantially equally spaced and located closely adjacent to the circumferential surface of donor roll 40. Electrical conductors 42 are electrically biased in the development zone to detach toner from donor roll 40. In this way, a toner powder cloud is formed in the gap between donor roll 40 and photoconductive surface 12. The latent image recorded on photoconductive surface 12 attracts toner particles from the toner powder cloud forming a toner powder image thereon. Donor roller 40 is mounted, at least partially, in the chamber of developer housing 44. The chamber in developer housing 44 stores a supply of developer material. The developer material is a two-component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller at a loading zone.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

Figure 2:
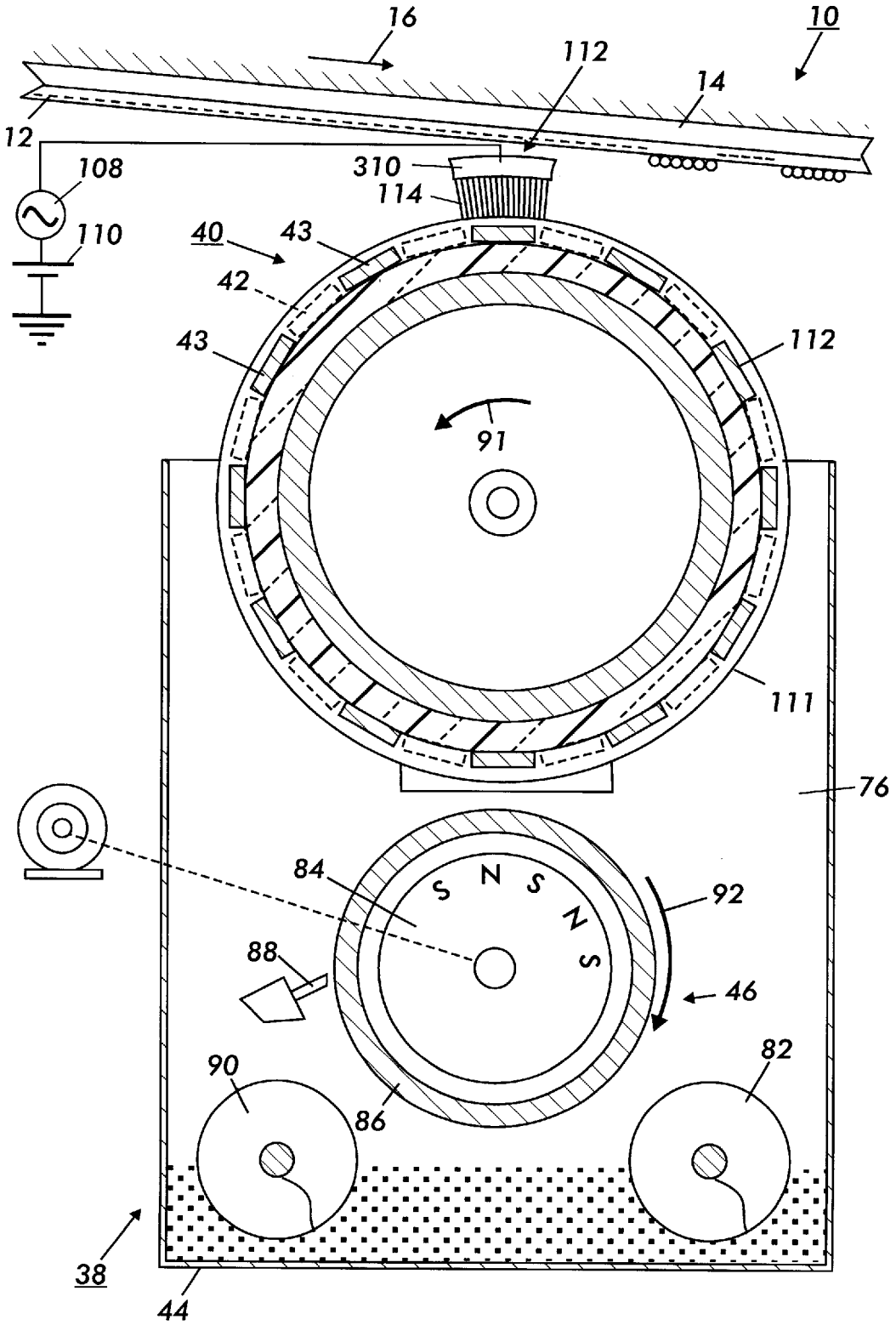
FIG. 2 is a schematic elevational view of an illustrative electrophotographic printing machine incorporating the FIG. 1 apparatus therein.

Referring now to FIG. 2, there is shown developer unit 38 in greater detail. As shown thereat, developer unit 38 includes a housing 44 defining a chamber 76 for storing a supply of developer material therein. In the preferred embodiment donor roll 40 has two interdigitated sets 42 and 43 of electrical conductors positioned in grooves about the peripheral circumferential surface thereof. The electrical conductors are substantially equally spaced from one another and insulated from each other. The electrodes of set 42 are connected commonly to a grounded slip ring not shown and the electrodes of set 43 are exposed at the end of the roll to the commutation brush 114. Donor roll 40 rotates in the direction of arrow 91. A magnetic roller 46 is also mounted in chamber 76 of developer housing 44. Magnetic roller 46 is shown rotating in the direction of arrow 92. Magnetic roller 46 and portions of donor roll 40 may be electrically biased relative to each other by AC and/or DC as required, by means not shown, in order to effect loading of toner from the magnetic roll 46 to the surface of the donor roll 40.

Electrode moves into the development zone where it comes into wiping contact with section 300 of brush 114 and is thereby connected to a DC voltage having an AC voltage superimposed thereon. In this way, an AC voltage difference is applied between the particular electrode 43 and the adjacent, grounded electrodes of the set 42 detaching toner from the donor roll and forming a toner powder cloud.

Magnetic roller 46 advances a constant quantity of toner having a substantially constant charge onto donor roll 40. This ensures that donor roller 40 provides a constant amount of toner having a substantially constant charge in the development zone. Metering blade 88 is positioned closely adjacent to magnetic roller 46 to maintain the compressed pile height of the developer material on magnetic roller 46 at the desired level. Magnetic roller 46 includes a non-magnetic tubular member 86 made preferably from aluminum and having the exterior circumferential surface thereof roughened. An elongated magnet 84 is positioned interiorly of and spaced from the tubular member. The magnet is mounted stationary. The tubular member rotates in the direction of arrow 92 to advance the developer material adhering thereto into a loading zone. In loading zone, toner particles are attracted from the carrier granules on the magnetic roller to the donor roller. Augers 82 and 90 are mounted rotatably in chamber 76 to mix and transport developer material. The augers have blades extending spirally outwardly from a shaft. The blades are designed to advance the developer material in a direction substantially parallel to the longitudinal axis of the shaft.

Figure 3:
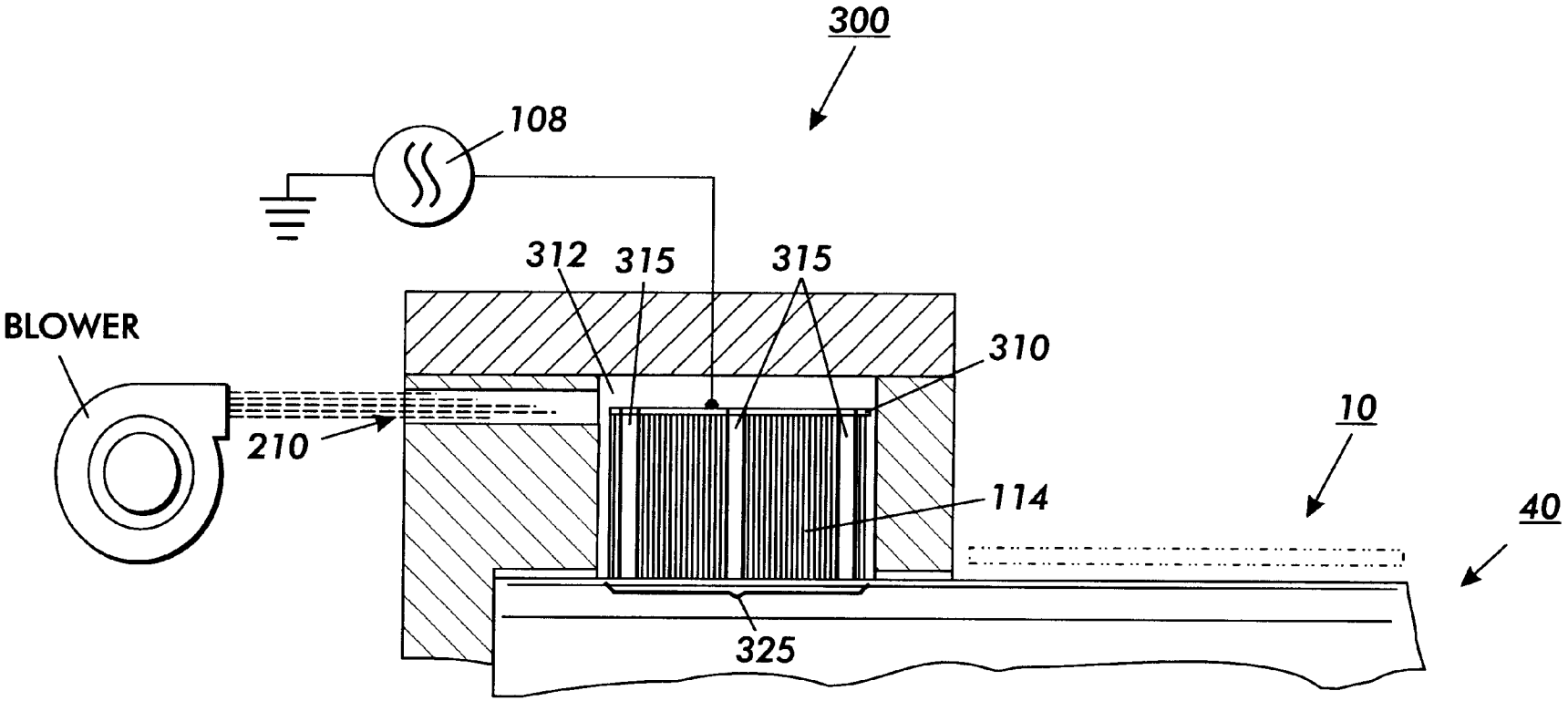
FIG. 3 is a side view of one embodiment of the brush commutator of the present invention.

Turning to FIG. 3, wiping brush 114 in greater detail, brush 114 is disposed at one end of the donor roll 40, preferably at a location spaced away from the length of the donor roll 40 corresponding to the imaging area on belt 10. It will be seen in FIG. 2 that the filaments of brush i 14 contact electrodes 43 at one end of the donor roll 40; contact by the filaments at this one point will energize the contacted electrodes 43 for the entire length thereof. Smooth and gradual potential changes are preferably brought about by the methods taught in U.S. Pat. No. 5,289,240, namely by making the brush fibers partially resistive and by providing in each brush portion central regions of relatively lower resistivity surrounded by regions of relatively higher resistivity.

Figure 5:
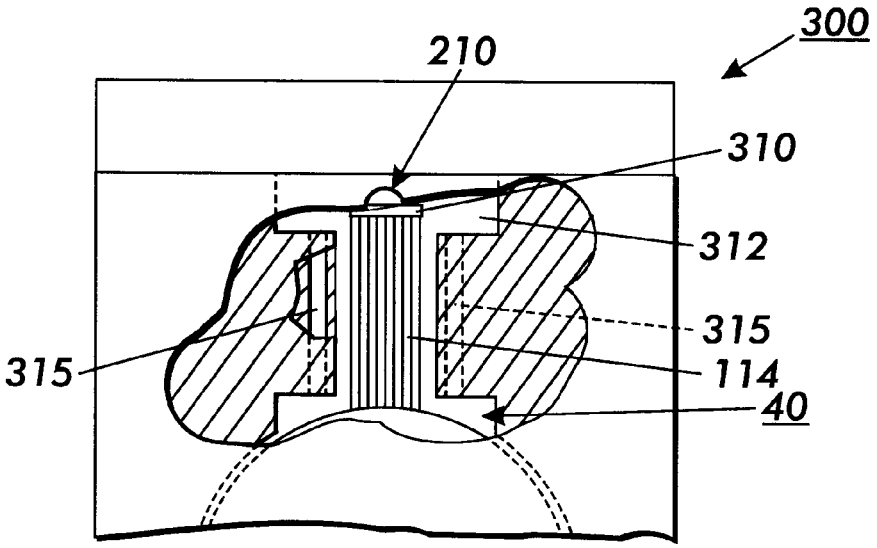
FIG. 5 is a front view of a third embodiment of the present invention.

Commutator assembly includes end cap 300 enclosing an end of roll 40 and has brush 114 incorporated therein. Brush 114 is positioned in cavity 312 located in end cap 300 which is open to roll 40. The filaments of brush 114 contact electrodes of roll 40 at commutation contact area 325. Brush back plate 310 binds filaments of brush 114 thereto and back plate 310 is electrically connected to the filaments of the brush; brush and back plate 310 partial fill cavity 312. Above back plate 310 there is an air supply opening 210 in which air is supplied thereto by a blower. The air pressure generates a pneumatic force on the surface of back plate 310. As shown in FIG. 4, back plate 310 has a plurality of apertures 315 which allows air to flow through, the air impinges on the commutator of roll 40 removing toner and other containments on the brush filaments and commutation contact area 325. Also, ozone that is generate due to high voltage applied filaments is removed from commutation contact area 325. As shown in FIG. 5, apertures 315 can be also located in the wall of cavity 312, or be grooves which are defined in the back and the brush filaments, as shown in FIG. 3.

In operation, a blower (not shown) supplies air to air supply opening 210 which applies pneumatic force to brush 114. For example, to maintain a load force of 50 g on a brush measuring 20 mm by 10 mm, an air pressure of 0.7psi is required.

Alternatively the air purge apertures could be incorporated into side plates attached directly to the brush with these side plates forming the sliding surface in cavity 312. Alternatively the air purge apertures could be formed directly into the sides of the brush as grooves.

The present invention has several advantages which includes; more compact design, easy brush replacement; machine control of brush contact force; possibility for brush retraction by modulation of air pressure/vacuum.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We Claim:

1. An apparatus for developing a latent image recorded on a surface, including:

a housing defining a chamber storing at least a supply of toner therein;

a donor member spaced from the surface and adapted to transport toner from the chamber of the housing to a development zone adjacent the surface;

a plurality of electrodes longitudinally disposed on the donor member;

a commutator brush contacting the electrodes along a portion of the circumference of the donor member, said commutator brush including means for generating pneumatic force to move said commutator brush into contact with the electrodes and a back plate having a plurality of brush filaments attached thereto, an end cap for supporting said donor member, said end cap having a cavity defined therein for holding said commutator brush, a blower for supply air to said cavity in a space above said back plate thereby providing pneumatic force to move said commutator brush into contact with said electrodes and wherein said back plate has a plurality of apertures defined therein, said apertures allow air to flow therethrough to clear toner and ozone from said portion.

2. An apparatus for developing a latent image recorded on a surface, including:

a housing defining a chamber storing at least a supply of toner therein;

a donor member spaced from the surface and adapted to transport toner from the chamber of the housing to a development zone adjacent the surface;

a plurality of electrodes longitudinally disposed on the donor member; and a commutator brush contacting the electrodes along a portion of the circumference of the donor member, said commutator brush including means for generating pneumatic force to move said commutator brush into contact with the electrodes, said commutator brush includes a back plate having a plurality of brush filaments attached thereto, an end cap for supporting said donor member, said end cap having a cavity defined therein for holding said commutator brush said cavity has a plurality of apertures defined therein, said apertures being positioned to allow air to clear toner and ozone from said portion.

* * * * *